US006640047B2

(12) United States Patent
Murahashi et al.

(10) Patent No.: US 6,640,047 B2
(45) Date of Patent: Oct. 28, 2003

(54) HYBRID WATER HEATER WITH ELECTRICAL HEATING UNIT AND COMBUSTOR

(75) Inventors: Hidemine Murahashi, Anjo (JP); Satoshi Nomura, Kariya (JP)

(73) Assignee: Denso Corporation, Kariya (JP)

( * ) Notice: Subject to any disclaimer, the term of this patent is extended or adjusted under 35 U.S.C. 154(b) by 65 days.

(21) Appl. No.: 10/113,274

(22) Filed: Apr. 1, 2002

(65) Prior Publication Data

US 2002/0146241 A1 Oct. 10, 2002

(30) Foreign Application Priority Data

Apr. 4, 2001 (JP) ..... 2001-106406
Nov. 26, 2001 (JP) ..... 2001-359585

(51) Int. Cl.[7] ..... F24H 3/00
(52) U.S. Cl. ..... 392/308; 392/449; 126/344
(58) Field of Search ..... 392/307, 308, 392/441, 449, 450, 451; 126/344, 367.1, 360.1, 362.1

(56) References Cited

U.S. PATENT DOCUMENTS 2,642,046 A * 6/1953 Alexander ..... 122/15.1
3,249,303 A * 5/1966 Townsend ..... 237/8 R
4,037,785 A * 7/1977 Madern ..... 126/610
4,498,622 A * 2/1985 Harnish ..... 236/25 R
5,660,165 A * 8/1997 Lannes ..... 126/641
6,370,328 B1 * 4/2002 Mottershead ..... 392/452

FOREIGN PATENT DOCUMENTS

| | | |
|---|---|---|
| JP | U-57-174960 | 4/1956 |
| JP | U-62-50463 | 3/1987 |
| JP | U-5-32953 | 4/1993 |
| JP | A-8-5146 | 1/1996 |
| JP | A-2000-97493 | 4/2000 |

* cited by examiner

*Primary Examiner*—Thor Campbell
(74) *Attorney, Agent, or Firm*—Harness, Dickey & Pierce, PLC

(57) ABSTRACT

In a hybrid water heater, a heat pump unit and a combustion heating unit are combined for heating water to be stored in a hot water tank. The combustion heating unit includes a combustor for heating water in a chamber by combustion operation. The chamber of the combustion heating unit communicates with the hot water tank through a first water port provided at an upper side of the hot water tank and a second water port provided at a lower side of the hot water tank, so that hot water heated in the chamber flows into the upper side in the hot water tank through the first water port, by using natural convection. Further, water in the hot water tank at the lower side flows from the second water port into the chamber.

17 Claims, 6 Drawing Sheets

HYBRID WATER HEATER WITH ELECTRICAL HEATING UNIT AND COMBUSTOR

CROSS-REFERENCE TO RELATED APPLICATION

This application is related to and claims priority from Japanese Patent Applications No. 2001-106406 filed on Apr. 4, 2001 and No. 2001-359585 filed on Nov. 26, 2001, the contents of which are hereby incorporated by reference.

BACKGROUND OF THE INVENTION

1. Field of the Invention

The present invention relates to a hybrid water heater in which a combustor for heating water is combined with an electrical heating unit having a hot water tank.

2. Description of Related Art

As a conventional water heater, an electrical water heater or a combined water heater is used. In the electrical water heater, water is heated by an electrical heating member, and the heated water (hot water) is stored in a hot water tank while its temperature is maintained. However, in the electrical water heater, when a large amount of hot water is used at one time, the amount of hot water in the hot water tank may be deficient. Accordingly, it is necessary to enlarge the hot water tank, for preventing the hot water in the hot water tank from being deficient.

On the other hand, in the combined water heater, because a combustion heating unit using a combustor is simply combined with the electrical water heater, an entire system structure of the combined water heater becomes complex. Accordingly, a control valve, for switching one flow of hot water from the electrical water heater and hot water from the combustion heating unit, is required, for example.

SUMMARY OF THE INVENTION

In view of the foregoing problems, it is an object of the present invention to provide a hybrid water heater which has a simple combination structure while it can effectively prevent hot water from being deficient.

According to the present invention, in a hybrid water, an electrical heating unit and a combustion heating unit are disposed to heat water to be stored in a hot water tank. The combustion heating unit includes a combustor for heating water in a chamber. The chamber has a first water port at an upper side, through which heated water flows from the camber into an upper side in the hot water tank, and a second water port at a lower side, through which water at a lower side in the hot water tank flows into the camber. In the hybrid water heater, the hot water tank and the chamber are disposed to communicate with each other through the first water port and the second water port, in such a manner that the water heated in the chamber is stored in the hot water tank at the upper side using natural convection due to a temperature increase of the water in the chamber. Accordingly, even in such a condition where hot water deficiency occurs when only using the electrical heating unit, hot water heated by the combustor in the camber can be stored in the hot water tank at the upper side. Therefore, the hot water deficiency can be effectively prevented without particularly enlarging the size of the hot water tank. Further, the high-temperature hot water due to the gas combustion flows into the hot water tank at the upper side using the natural convection. Therefore, a control valve and the like, for switching a hot water circuit between the electrical heating unit and the combustion heating unit, is not required, thereby simplifying an entire system structure of the hybrid water heater. Furthermore, in the hot water tank, the high-temperature hot water is not mixed with low-temperature water at the lower side, and is stored at the upper side. Therefore, the high-temperature hot water due to the gas combustion can be effectively used for a supply.

Preferably, a control unit for controlling the combustion operation of the combustor has determining means for determining whether or not hot water in the hot water tank is deficient for a supply. When it is determined that the hot water in the hot water tank is deficient, the combustor is operated by the control unit to heat water in the chamber. Alternatively, when it is determined that a hot water state in the hot water tank is a state incapable to supply hot water to a hot-water supply equipment, the combustor is operated by the control unit to heat water in the chamber. Alternatively, when a command, for supplying hot water higher than that of the hot water in the hot water tank, is input from a user, the combustor is operated by the control unit to heat water in the chamber. Accordingly, even when the size of the hot water tank is made smaller, necessary hot water can be rapidly supplied from the hot water tank.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PRESENTLY PREFERRED EMBODIMENTS

Preferred embodiments of the present invention will be described hereinafter with reference to the accompanying drawings.

Figure 1:
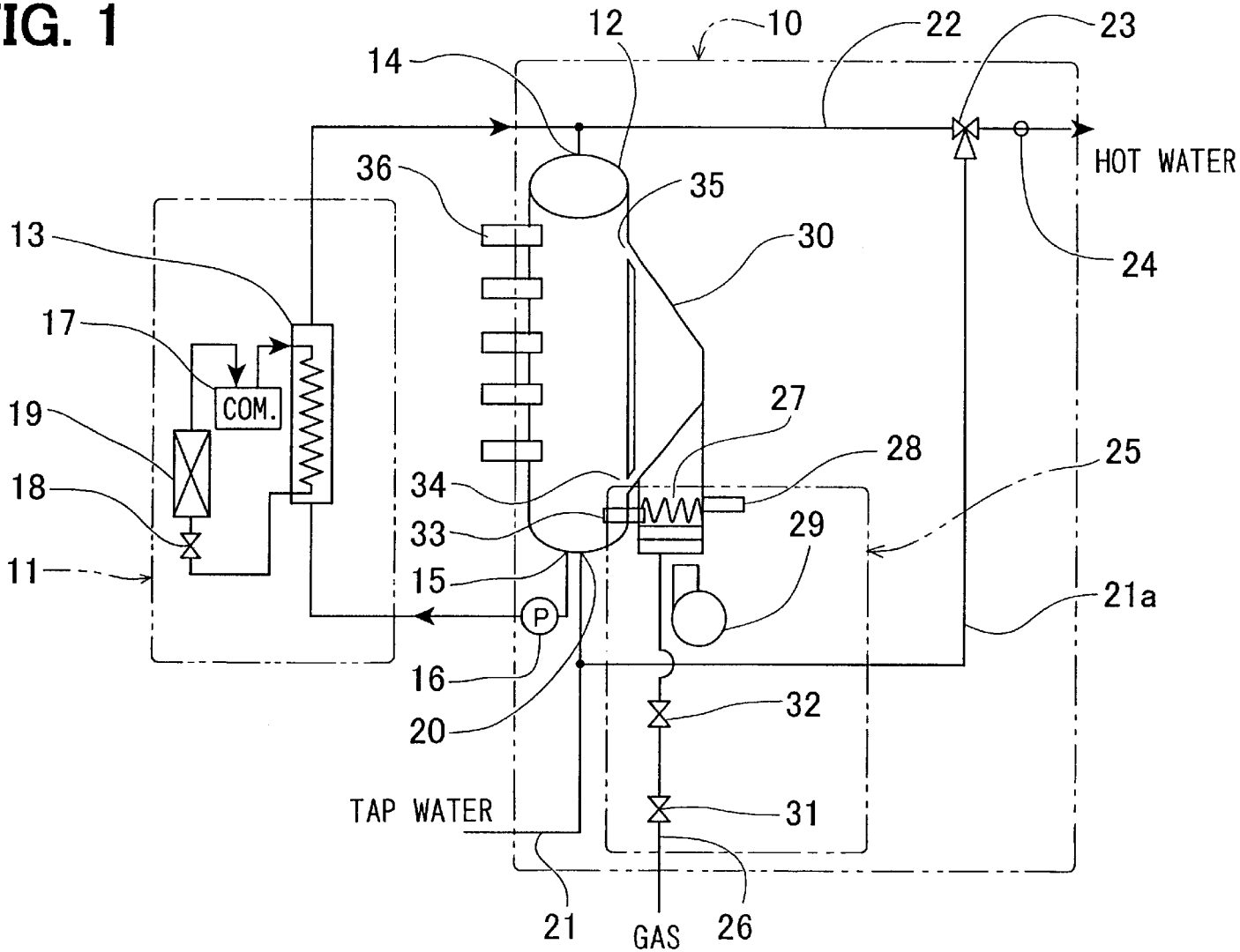
FIG. 1 is a schematic diagram showing an entire system of a hybrid water heater according to a first embodiment of the present invention.

A first embodiment of the present invention will be now described with reference to FIGS. 1–3. In the first embodiment, a hybrid water heater according to the present invention is typically used for a home water heater. As shown in FIG. 1, the hybrid water heater is constructed by a hot-water tank unit 10 and a heat pump unit 11. The hot-water tank unit 10 includes a hot water tank 12 extending in a vertical direction (up-down direction). High-temperature hot water, heated by a high-pressure side heat exchanger (radiator) 13 of the heat pump unit, flows into the hot water tank 12 from a hot water port 14 provided on a top portion of the hot water tank 12. Low-temperature water flows into the radiator 13 from a water outlet port 15 provided on a bottom portion of the hot water tank 12, by operation of an electrical pump 16.

In the heat pump unit 11, high-pressure refrigerant, compressed by an electrical compressor 17, flows into the radiator 13, and the high-pressure refrigerant is heat-exchanged with low-temperature water in the radiator 13 so that the low-temperature water is heated while passing through the radiator 13. High-pressure refrigerant from the compressor 17 is cooled in the radiator 13, and is decompressed in a decompression unit 18 to be low-pressure refrigerant. The low-pressure refrigerant from the decompression unit 18 flows into an evaporator 19, and is evaporated by absorbing heat from atmospheric air in the evaporator 19. Thereafter, the evaporated gas refrigerant is sucked into the compressor 17, so that the low-pressure refrigerant is compressed again in the compressor 17. The heat pump unit 11 is an electrical heating unit operated mainly at night using low-priced night electrical power.

A water inlet 20, from which tap water and the like is supplied into the hot water tank 12, is provided on the bottom portion of the hot water tank 12. Further, a water pipe 21*a* is branched from a portion of a water pipe 21 connected to the water inlet 20. A hot water pipe 22, in which the high-temperature hot water from the hot water port 14 flows, is joined with the water pipe 21*a* at a join portion, and a temperature adjusting valve 23 is provided at the join portion.

The temperature adjusting valve 23 adjusts a mixing ratio between the high-temperature hot water (e.g., 60-90° C.) stored in the hot water tank 12 and low-temperature water from the water pipe 21*a*, so that the temperature of hot water to be supplied can be suitably adjusted. In the first embodiment, the temperature adjusting valve 23 is driven by an actuator such as a motor, and its valve position is automatically adjusted based a temperature detected by a temperature sensor (thermistor) 24 for detecting the temperature of the mixed water. Thus, the temperature of the mixed water from the hot water pipe 22 and the water pipe 21*a* can be maintained at a target temperature. A downstream side of the temperature adjusting valve 23 in the hot water pipe 22 is connected to a hot-water supply equipment in a home such as a washroom and a bathroom, for example.

A gas combustor 25 is provided in the hot-water tank unit 10. In the gas combustor 25, gas (e.g., city gas) is supplied into a combustion chamber 27 through a gas pipe 26, and is ignited by an ignition device 28. The gas from the gas pipe 26 is mixed with combustion air blown by an electrical blower 29 in the combustion chamber 27, for burning.

A water-heating chamber 30 is provided above the gas combustor 25. In the water-heating chamber 30, water is heat-exchanged with combustion gas generated by combustion between gas and combustion air in the gas combustor 25, to be heated. The combustion gas in the gas combustor 25 flows along an outer surface of a bottom portion of the water-heating chamber 30, to be sufficiently heat-exchanged with water in the water-heating chamber 30. Thereafter, the combustion gas is discharged outside the gas combustor 25. Accordingly, in the first embodiment, a combustion heating unit is constructed mainly by the gas combustor 25 and the water-heating chamber 30.

First and second solenoid valves 31, 32 are provided in series in the gas pipe 26 to improve a safety in a closing operation of a gas supply. A flame sensor 33 for detecting a combustion flame state is provided in the combustion chamber 27, so that the combustion operation is controlled using a detection signal from the flame sensor 33.

Hot-water circulation is performed between the hot water tank 12 and the water-heating chamber 30 by natural convection using mass-density difference of water in the water-heating chamber 30 due to a temperature difference of the water. As shown in FIG. 1, a water port 34, through which a lower side portion of hot water tank 12 communicates with the water-heating chamber 30, is provided at a lower side in the water-heating chamber 30. Further, a hot water port 35, through which an upper side portion in the hot water tank 12 communicates with the water-heating chamber 30, is provided at an upper side of the water-heating chamber 30.

In the hot water tank 12 extending in the vertical direction, plural temperature sensors (e.g., five sensors in FIG. 1) 36 each detecting the temperature of water therein are provided at different height positions in the vertical direction, respectively. A temperature distribution (temperature gradient) of water in the hot water tank 12 in the vertical direction can be determined using detection signals from the plural temperature sensors 36. That is, using the detection signals from the plural temperature sensors 36, it can be determined whether or not hot water having a predetermined temperature (e.g., 60° C.) or higher is smaller than a necessary amount in the hot water tank 12. Accordingly, it can determine whether or not hot water is in a deficient state in the hot water tank 12.

Figure 2:
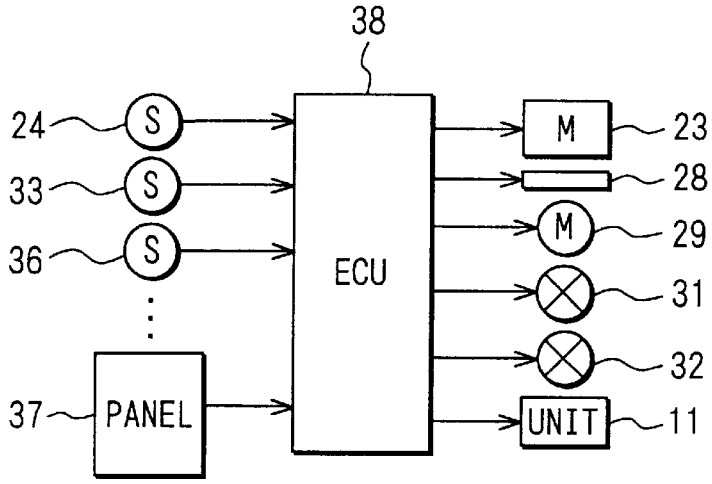
FIG. 2 is a block diagram showing electrical control of an electronic control unit according to the first embodiment.

As shown in FIG. 2, detection signals from a sensor group 24, 33, 36 and the like and operation signals from an operation panel 37 are inputted to an electronic control unit (ECU) 38. Then, the ECU 38 controls operation of each equipment 11, 23, 28, 29, 31, 32 shown in FIG. 1 by performing a predetermined operational process based on the input signals.

Figure 3:
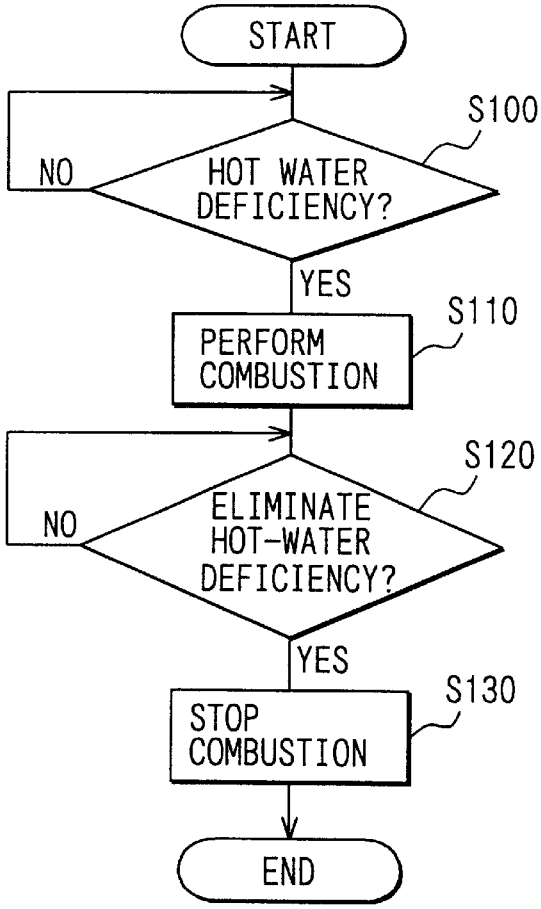
FIG. 3 is a flow diagram showing control operation of the hybrid water heater according to the first embodiment.

For example, the ECU 38 controls operation of the gas combustor 25 as shown in FIG. 3. As shown in FIG. 3, first, it is determined whether or not the hot water is deficient in the hot water tank 12 at step S100. Specifically, the temperature gradient (temperature distribution) of water in the hot water tank 12 in the vertical direction is determined using the detection signals from the plural temperature sensors 36 arranged in the vertical direction in the hot water tank 12. Then, it is determined, based on the determined temperature distribution (gradient), whether or not the amount of the hot water having a temperature equal to or higher than a predetermined temperature (e.g., 60° C.) is larger than a necessary amount in the hot water tank 12. When the amount of the hot water in the hot water tank 12 is larger than the necessary amount in the hot water tank 12, it is determined that the amount of the hot water is sufficient in the hot water tank 12, and a control routine is ended.

On the other hand, when the amount of the hot water having a temperature equal to or higher than the predetermined temperature is smaller than the necessary amount in the hot water tank 12, it is determined that the hot water is deficient, and a control program proceeds to step S110. At the step S110, the gas combustor 25 starts operation of gas combustion. Specifically, both the solenoid valves 31, 32 are opened, and the ignition device 28 and the electrical blower 29 are operated, so that the gas combustion of the gas combustor 25 is performed. Next, at step S120, it is determined whether or not the hot-water deficient state is eliminated in the hot water tank 12. That is, at step S120, it is determined whether or not the amount of the hot water having the temperature equal to or higher than the predetermined temperature is recovered larger than the necessary amount. This determination at step S120 can be performed based on the temperature distribution in the vertical direction in the hot water tank 12 as described at step S100.

The gas combustion operation of the gas combustor 25 is continued until the hot-water deficiency is eliminated in the ECU 38. The water in the lower side portion of the water-heating chamber 30 is mainly heated by the gas combustion. When the temperature of the heated water is increased, and the mass density of the heated water is reduced. Therefore, the heated water is moved upward in the water-heating chamber 30 by natural convection, and the high-temperature hot water in the upper side part of the water-heating chamber 30 flows from the hot water port 35 into the upper side in the hot water tank 12. Thus, the high-temperature hot water is gradually stored in the upper side of the hot water tank 12. This hot-water supply from the water-heating chamber 30 to the hot water tank 12 is similar to the case where the high-temperature hot water heated in the heat pump unit 11 is supplied from the hot water port 14 into the upper side in hot water tank 12. Accordingly, even when the high-temperature hot water flows from the water-heating chamber 30 into the hot water tank 12, a temperature boundary between the high-temperature hot water and the low-temperature water is not disturbed in the hot water tank 12.

At the lower side in the hot water tank 12, the water temperature is low and the mass density of the water is large. Therefore, the water at the lower side in the hot water tank 12 flows from the water port 34 into the lower side part of the water-heating chamber 30, and is heated by the combustion operation of the gas combustor 25. The water temperature in the hot water tank 12 is increased by using the water-heating operation and the hot-water circulation operation due to the gas combustion. When it is determined that the hot-water deficient state is eliminated at step S120, the control program proceeds to step S130. At step S130, both solenoid valves 31, 32 of the gas combustor 25 are closed, and the electrical blower 29 is stopped, so that the gas combustion in the gas combustor 25 is stopped.

In the first embodiment, when it is determined that the amount of hot water is reduced equal to or lower than the necessary amount in the hot water tank 12, the combustion operation of the gas combustor 25 is started, so that water in the water-heating chamber 30 is heated by the combustion operation of the gas combustor 25. Accordingly, high-temperature hot water in the water-heating chamber 30 flows into the upper side in the hot water tank 12 using natural convection. Therefore, the high-temperature hot water due to the combustion operation of the gas combustor 25 is gradually stored in the hot water tank 12 at the upper side, similarly to the flow of the high-temperature hot water from the heat pump unit 11.

Accordingly, it can prevent hot water from being deficient without particularly enlarging the size of the hot water tank 12. Therefore, the hybrid water heater according to the first embodiment is particularly advantageous for actual use. Generally, a tank capacity of the hot water tank 12, including a spare capacity, is required to be about 300 liter to prevent an amount of hot water from being deficient for a family of four, for example. In the first embodiment, the water heating function due to the gas combustion is combined with the water heating function due to the heat pump unit 11. Accordingly, even when the tank capacity of the hot water tank 12 is set at about 150 liter, which is an amount of hot water used by a family of four for a day in average, it can prevent hot water from being deficient.

Further, the high-temperature hot water due to the combustion operation of the gas combustor 25 flows into the upper side in the hot water tank 12 using natural convection. Therefore, a control valve, for switching one flow of the high-temperature hot water from the heat pump unit 11 and the high-temperature hot water due to the combustion operation, is not required, thereby simplifying an entire system structure of the hybrid water heater. Furthermore, in the hot water tank 12, the high-temperature hot water is not mixed with low-temperature water at the lower side, and is favorably stored at the higher side. Therefore, the high-temperature hot water due to the combustion operation of the gas combustor 25 can be effectively used.

According to experiments of the inventors of the present application, when the hot water port 35 of the water-heating chamber 30 is located on the hot water tank 12 at an upper side position of ⅔ or more of its entire length from the bottom of the hot water tank 12 in the vertical direction, the high-temperature hot water due to the combustion operation of the gas combustor 25 can be effectively stored at the upper side in the hot water tank 12.

On the other hand, when the temperature of hot water supplied from the hot water tank 12 to the heat pump unit 11 is increased, the pressure of high-pressure side refrigerant in the refrigerant cycle system is increased, and consumed power of the compressor 17 is increased. Therefore, in this case, coefficient of performance (COP) of the refrigerant cycle system is reduced. However, in the first embodiment, the hot water deficiency is prevented, by the combination of the water heating function due to the combustion operation of the gas combustor 25 and the water heating function due to the heat pump unit 11. Therefore, it is unnecessary to increase the temperature of the hot water supplied to the heat pump unit 11, for preventing the amount of the hot water from being deficient. Accordingly, the COP of the refrigerant cycle in the heat pump unit 11 can be improved by decreasing the temperature of the hot water supplied to the radiator 13 of the heat pump unit 11.

When a super-critical refrigerant cycle, where the pressure of the high-pressure side refrigerant is equal to or higher than the critical pressure of the refrigerant, is used for the heat pump unit 11, the COP of the super-critical refrigerant cycle is greatly improved by the supply of low-temperature water into the heat pump unit 11. In the super-critical refrigerant cycle, carbon dioxide can be used as the refrigerant, for example.

Figure 4:
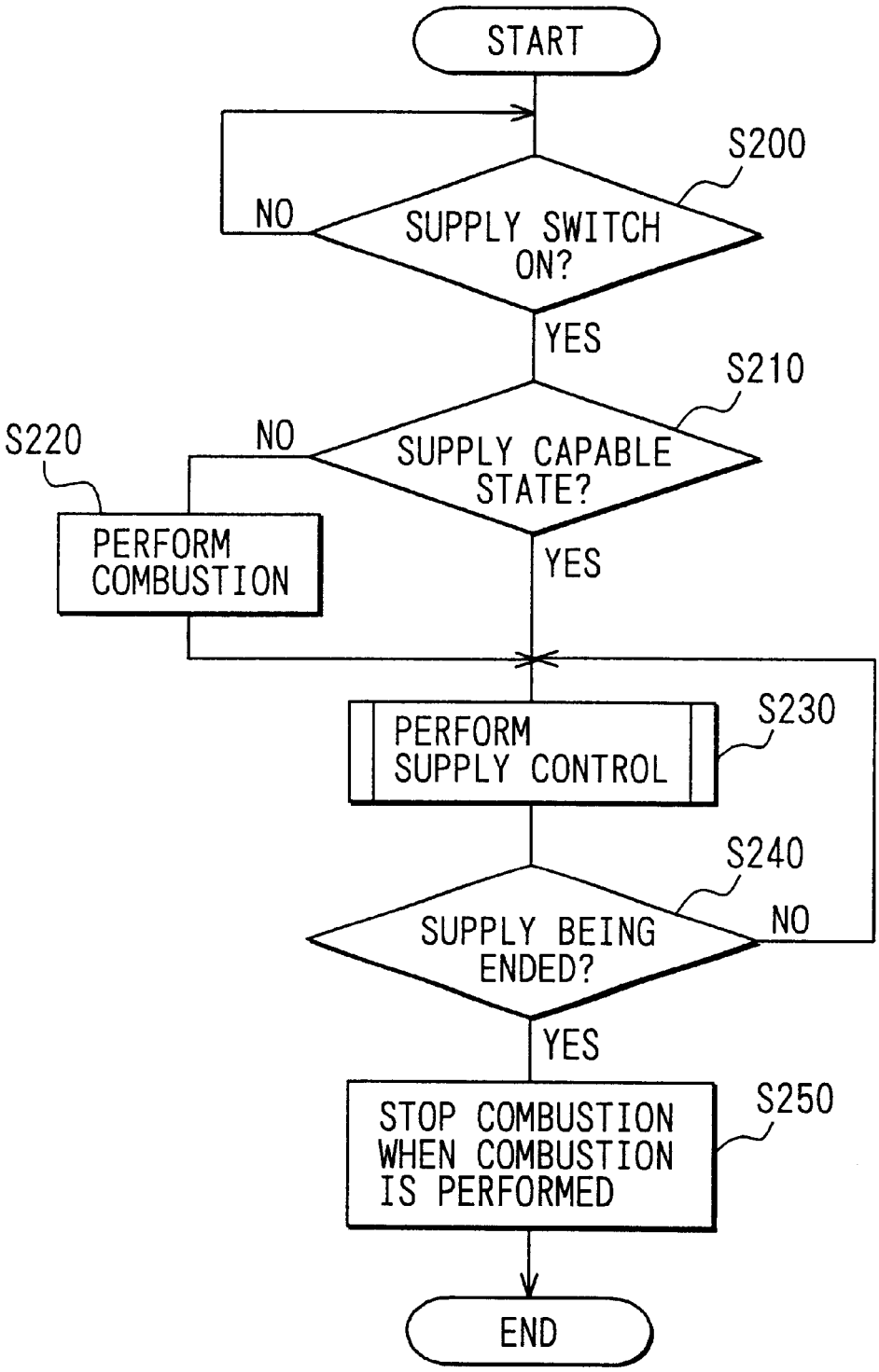
FIG. 4 is a flow diagram showing control operation of a hybrid water heater according to a second embodiment of the present invention.

A second embodiment of the present invention will be now described with reference to FIG. 4. In the second embodiment, as shown in FIG. 4, a hot water supply to a hot-water supply equipment such as a bathroom (e.g., bathtub) is controlled. Here, the hot-water supply equipment is connected to the hot water pipe 22 at a downstream side of the temperature adjusting valve 23. In the second embodiment, first, it is determined whether or not a hot-water supply switch (not shown) provided on the operation panel 37 is turned on at step S200. For example, the supply switch is a bath automatic switch for commanding a supply of hot water to the bathtub. When the hot-water supply switch is turned on, it is determined whether or not the hot water in the hot water tank 12 is in a supply capable state at step S210. That is, at step S210, it is determined, based on the temperature distribution in the hot water tank 12, whether or not the amount of hot water having a necessary temperature, commanded by a user, can be supplied to the bathtub using the hot water stored in the hot water tank 12. Here, the temperature distribution (gradient) of hot water in the hot water tank 12 is determined using the temperature sensors 36. The amount of hot water to be supplied is commanded by a user using a hot-water supply amount switch (not shown) provided on the operation panel 37.

When it is determined that the commanded amount of hot water cannot be supplied to the bathtub using the hot water stored in the hot water tank 12, the combustion operation is performed in the gas combustor 25 at step S220. Then, at step S230, a valve opening degree of the temperature adjusting valve 23 is controlled so that the temperature of hot water to be supplied to the bathtub is controlled at the temperature of hot water (target temperature) commanded by the user. Accordingly, at step S230, the hot water to be supplied to the bathtub can be controlled. At step S210, when it is determined that the commanded amount of hot water can be supplied to the bathtub using the hot water stored in the hot water tank 12, the hot water to be supplied to the bathtub is controlled directly at step S230. Next, at step S240, it is determined whether or the hot-water supply operation is ended using a flowmeter for detecting the amount of hot water supplied to the bathtub, or a pressure switch for detecting a water pressure corresponding to a water level in the bathtub or the like. The hot-water supply control is continued at the step S230 until the hot-water supply operation is ended. When the hot-water supply operation is ended, the control program proceeds to step S250. At step S250, the combustion operation is ended when the combustion operation is performed in the gas combustor 25. In the second embodiment, the structure of the hybrid water heater shown in FIG. 1 can be used.

Figure 5:
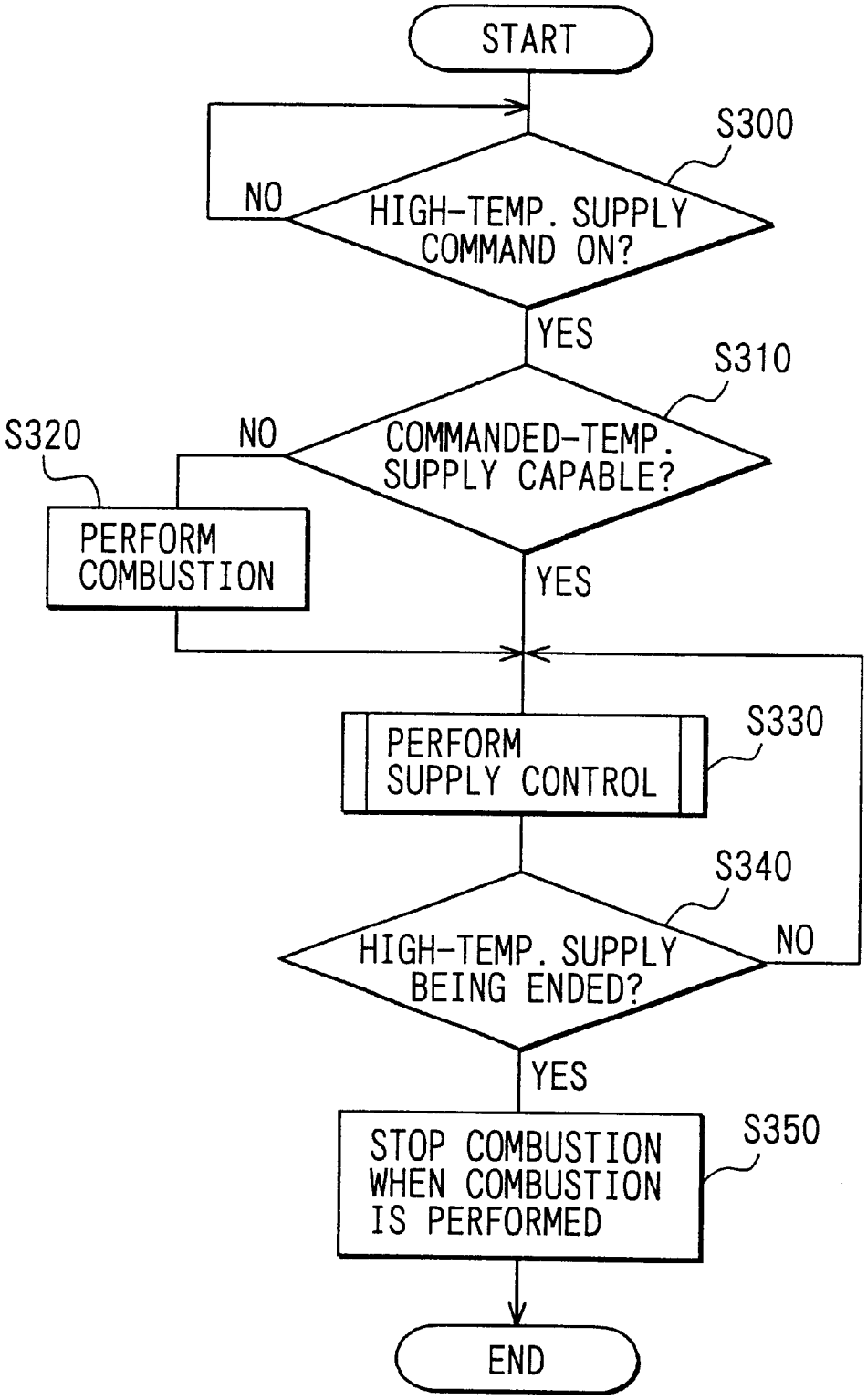
FIG. 5 is a flow diagram showing control operation of a hybrid water heater according to a third embodiment of the present invention.

A third embodiment of the present invention will be now described with reference to FIG. 5. As shown in FIG. 5, in the third embodiment, the hot water to be supplied is controlled when a target temperature of hot water to be supplied is a high temperature higher than the temperature of the hot water stored at the upper side in the hot water tank 12. The command for supplying the high-temperature hot water is performed using a target temperature setting switch (not shown) provided on the operation panel 37. First, at step S300, it is determined whether the high-temperature hot water (e.g., 80° C.) is commanded using the target temperature setting switch at step S300. When a supply of the high-temperature hot water is not commanded, the control program shown in FIG. 5 is not performed.

When this determination at step S300 is YES, that is, when it is determined that a supply of the high-temperature hot water is commanded at set S300, it is determined whether or not the hot water having the commanded temperature can be supplied using the hot water stored in the hot water tank 12 at step S310. That is, at step S310, it is determined, based on the temperature distribution in the hot water tank 12, whether the hot water having the commanded high temperature can be supplied using the hot water stored in the hot water tank 12. When it is determined that the hot water having the commanded high temperature is incapable be supplied using the hot water stored in the hot water tank 12, the combustion operation is performed in the gas combustor 25 at step S320. Thereafter, at step S330, the valve opening degree of the temperature adjusting valve 23 is controlled, so that the temperature of the hot water to be supplied is set at the commanded target temperature, and the hot-water supply control is performed.

Next, at step S340, it is determined whether or not the supply control of the high-temperature hot water is ended based on information such as a passing time after starting the hot-water supply operation and a supplied amount of hot water, or a canceling operation of the hot-water supply operation by the user. The supply control of the high-temperature hot water is continued at step S330 until the high-temperature hot-water supply operation is ended. When the high-temperature hot-water supply operation is ended at step S340, the combustion operation is stopped at step S350 when the combustion operation is performed in the gas combustor 25.

On the other hand, at step S310, when it is determined that the hot water having the commanded high temperature is capable to be supplied only using the hot water stored in the hot water tank 12, the supply control of high-temperature hot water is directly performed at step S330, without performing the combustion operation in the gas combustor 25. In the third embodiment, the structure of the hybrid water heater shown in FIG. 1 can be used.

Figure 6:
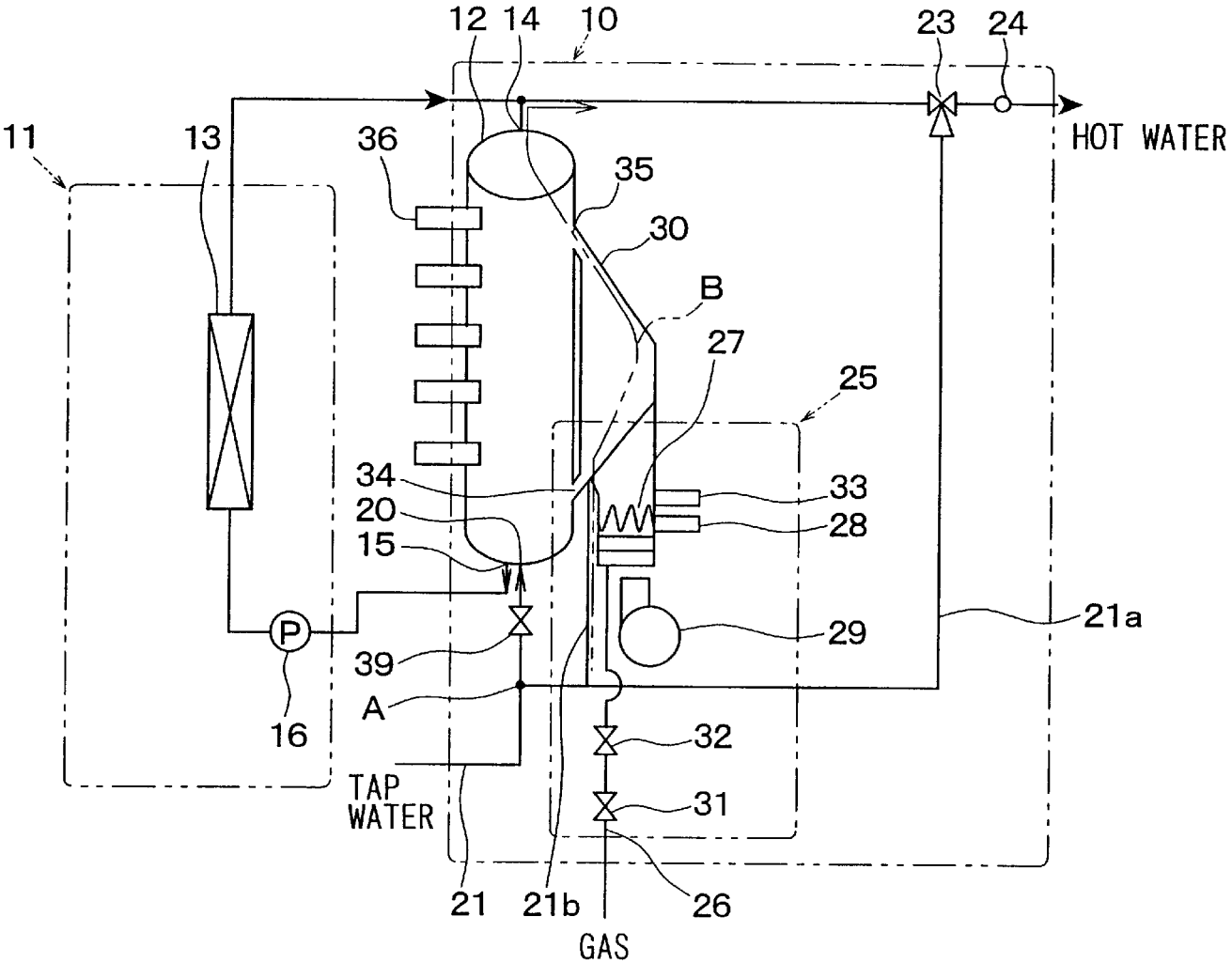
FIG. 6 is a schematic diagram showing an entire system of a hybrid water heater according to a fourth embodiment of the present invention.

A fourth embodiment of the present invention will be now described with reference to FIGS. 6 and 7. In the fourth embodiment, parts similar to those in the first embodiment are indicated by the same reference numbers, and detail description thereof is omitted. In the fourth embodiment, a water pipe 21*b* is newly branched from the water pipe 21, and is disposed to communicate with the lower side part in the water-heating chamber 30. Thus, tap water can be directly supplied into the lower side part in the water-heating chamber 30 through the water pipe 21*b*.

Further, a water-supply control valve (control valve) 39 is disposed in the water pipe 21 at a side of the water inlet 20 with respect to a branch point A where the water pipes 21*a*, 21*b* are branched from the water pipe 21. The control valve 39 is constructed by a solenoid valve and the like, and is controlled to be electrically opened and closed by the ECU 38.

Figure 7:
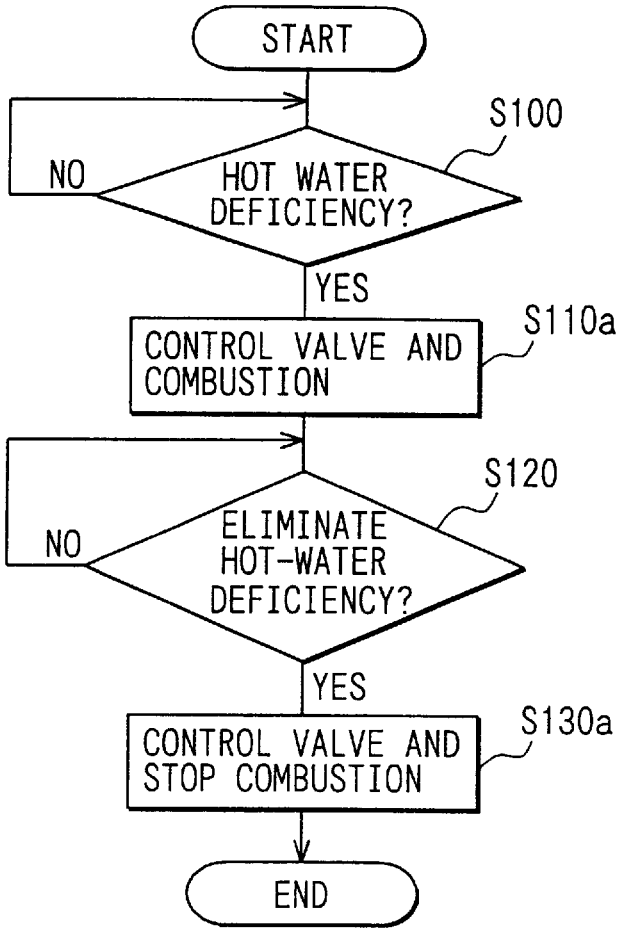
FIG. 7 is a flow diagram showing control operation of the hybrid water heater according to the fourth embodiment.

In the fourth embodiment, as shown in FIG. 7, it is determined whether or not the hot water in the hot water tank 12 is deficient at the step S100. This determination at step S100 is performed based on the temperature distribution in the hot water tank 12 as in the first embodiment. Here, the temperature distribution of hot water in the vertical direction in the hot water tank 12 can be determined using the temperature sensors 36. When it is determined that the amount of the hot water having a temperature higher than a predetermined temperature in the hot water tank 12 is smaller than a necessary amount, that is, when the hot water is determined to be deficient in the hot water tank 12, the control operation at step S110*a* is performed. At the step S110*a*, the control valve 39 is closed while the combustion operation is started in the gas combustor 25.

At step S120, it is determined whether or not the hot-water deficient state is eliminated. That is, at step S120, it is determined whether or not the amount of the hot water having the predetermined high temperature is recovered to be equal to or more than the necessary amount in the hot water tank 12, based on the temperature distribution in the hot water tank 12 in the vertical direction. The combustion operation of the gas combustor 25 and the closing state of the control valve 39 set at the step S110*a* are continued until the hot-water deficient state is eliminated in the hot water tank 12. At the step S110*a*, the combustion operation is performed in the gas combustor 25 while the water supply to the water inlet 20 is stopped by using the control valve 39. Therefore, the tap water can be directly introduced into the lower side part of the water-heating chamber 30 to be heated by combustion heat of the gas combustor 25.

In this case, the pressure of tap water is applied to the water in the water-heating chamber 30, while being not directly applied to the water in the hot water tank 12 because the control valve 39 is closed. Therefore, the low-temperature water is hardly supplied from the hot water tank 12 by the water pressure. The tap water, directly introduced from the water pipe 21*b*, is heated in the water-heating chamber 30, and the heated high-temperature hot water can be rapidly supplied to the hot-water supply equipment such as the bathroom as shown by the chain-line arrow B. That is, a hot water flow, indicated by the chain-line arrow B in FIG. 6, can be formed by the pressure of tap water applied to the water in the water-heating chamber 30, in addition to the use of the natural convection due to a temperature difference of the water described in the first embodiment. Therefore, the hot water, heated by combustion heat of the gas combustor 25, can be immediately supplied to a hot-water supply equipment through the hot water tank 12 along the chain-line arrow B. Accordingly, when the hot water deficiency occurs, the hot water deficiency can be rapidly eliminated.

When the amount of hot water to be supplied to the hot-water supply equipment is reduced or hot-water supply to the hot-water supply equipment is stopped, the flow amount of hot-water along the chain-line arrow B is reduced, or is stopped. In this case, the hot-water circulation is performed between the water-heating chamber 30 and the hot water tank 12 using the natural convection due to the temperature difference. Thus, high-temperature hot water is gradually stored in the hot water tank 12 from the upper side. When the temperature of the hot water is increased in the hot water tank 12 and it is determined that the hot water deficiency is eliminated at step S120, the control operation at step S130*a* is performed. At step S130*a*, both solenoid valves 31, 32 of the gas combustor 25 are closed, the electrical blower 29 is stopped, and the gas combustion is stopped. At the same time, the control valve 39 is opened so that tap water can be directly introduced to the bottom side in the hot water tank 12.

In the fourth embodiment, the control valve 39 restricts tap water from being directly introduced from the water pipe 21 into the bottom side of the hot water tank 12 when the combustion operation is performed in the gas combustor 25. That is, in the fourth embodiment, the control valve 39 is fully closed when the combustion operation of the gas combustor 25 is performed. However, the control valve 39 may be restricted at a small open degree without being entirely closed even when the combustion operation of the gas combustor 25 is performed.

In the fourth embodiment, the other parts are similar to those of the above-described first embodiment.

Figure 8:
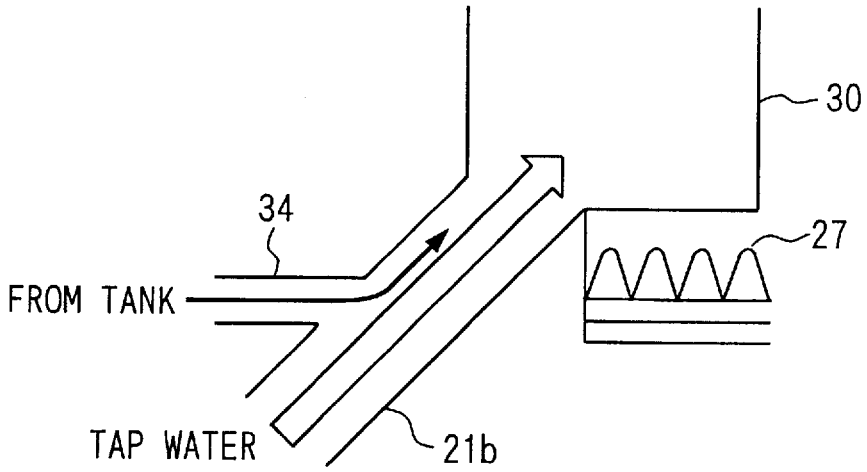
FIG. 8 is a schematic sectional view showing a main part of a hybrid water heater according to a fifth embodiment of the present invention.

A fifth preferred embodiment of the present invention will be now described with reference to FIG. 8.

In the above-described fourth embodiment, the water is sucked from the water port 34 into the water-heating chamber 30 by the dynamic pressure of the hot water flow indicated by the chain line arrow B. Accordingly, as the flow amount of water sucked from the water port 34 into the water-heating chamber 30 increases, an amount of a hot water flow, branched from the hot water flow B, to be introduced toward the water port 34 at the lower side in the hot water tank 12, is increased. That is, the amount of the hot water flow B toward the hot-water supply equipment is not effectively increased, when the flow amount of water sucked from the water port 34 into the water-heating chamber 30 increases.

In the fifth embodiment, the flow amount of water, sucked from the water port 34 into the water-heating chamber 30 by the dynamic pressure of the hot water flow B, is restricted. Specifically, as shown in FIG. 8, a passage sectional area of the water port 34 is set smaller than a passage sectional area of the water pipe 21*b*. In an example shown in FIG. 8, the water port 34, having a small passage sectional area, is connected to a middle portion in the water pipe 21*b* having a larger passage sectional area. The water pipe 21*b* having the water port 34 is connected to the water-heating chamber 30 at one position.

In the fifth embodiment, a water passage resistance in the water port 34 is set larger than that in the water pipe 21*b*. Therefore, even when the hot water flow B shown in FIG. 6 is formed, the flow amount of water, sucked from the water port 34 into the water-heating chamber 30 by the dynamic pressure of the hot water flow B, is restricted. Thus, the hot water, heated by the combustion operation of the gas combustor 25, can be effectively supplied to the hot-water supply equipment. Accordingly, in the fifth embodiment, the hot water deficiency can be more rapidly effectively eliminated. In the fifth embodiment, the control operation of the gas combustor 25 can be performed as in the fourth embodiment.

Further, when the hot water supply to the hot-water supply equipment is stopped, the hot water flow B disappears. Therefore, the control valve 39 may be opened at this time. Accordingly, even when the combustion operation is continued in the gas combustor 25, the control valve 39 may be opened when the hot-water supply to the hot-water supply equipment is stopped.

Although the present invention has been fully described in connection with the preferred embodiments thereof with reference to the accompanying drawings, it is to be noted that various changes and modifications will become apparent to those skilled in the art.

For example, the hybrid water heater according to the present invention may be used for a water heater where an electrical heater, for directly heating water in the hot water tank 12, is disposed in the hot water tank 12 as an electrical water-heating unit in place of the heat pump unit 11. A combustor, using a liquid fuel such as kerosene, may be used in place of the gas combustor 25.

Such changes and modifications are to be understood as being within the scope of the present invention as defined by the appended claims.

What is claimed is:

1. A hybrid water heater for supplying hot water to a hot-water supply equipment, comprising:

a hot water tank;

an electrical heating unit for heating water to be stored in the hot water tank; and a combustion heating unit for heating water to be stored in the hot water tank, the combustion heating unit including a combustor for heating water by combustion operation, and a chamber in which water is heated by the combustion operation of the combustor, the chamber having a first water port at an upper side, through which heated water flows from the chamber into an upper side in the hot water tank, and having a second water port at a lower side, through which water at a lower side in the hot water tank flows into the chamber, wherein the hot water tank and the chamber are disposed to communicate with each other through the first water port and the second water port, in such a manner that the water heated in the chamber is stored in the hot water tank at the upper side using natural convection due to a temperature increase of the water in the chamber.

2. The hybrid water heater according to claim 1, wherein the electrical heating unit is an electrical heat pump unit including an electrical compressor for compressing refrigerant.

3. The hybrid water heater according to claim 2, wherein:

the electrical heat pump unit further includes a radiator in which refrigerant from the compressor is heat-exchanged with water to be supplied to the upper side in the hot water tank; and the radiator and the hot water tank are coupled in such a manner that water at the lower side in the hot water tank is supplied to the radiator.

4. The hybrid water heater according to claim 3, wherein the refrigerant is carbon dioxide.

5. The hybrid water heater according to claim 1, wherein the combustor is disposed to heat a bottom portion of the chamber.

6. The hybrid water heater according to claim 1, wherein:

the hot water tank is disposed to extend in a vertical direction; and the first water port is provided at a height position of ⅔ or more of an entire length of the hot water tank from a bottom of the hot water tank in the vertical direction.

7. The hybrid water heater according to claim 1, further comprising a control unit for controlling combustion operation of the combustor, wherein:

the control unit has determining means for determining whether or not hot water in the hot water tank is deficient; and when it is determined that the hot water in the hot water tank is deficient, the combustor is operated by the control unit to heat water in the chamber.

8. The hybrid water heater according to claim 7, wherein:

the determining means of the control unit determines whether an amount of hot water having a temperature higher than a predetermined temperature is equal to or larger than a necessary amount in the hot water tank at the upper side; and when the amount of the hot water having the temperature higher than the predetermined temperature is smaller than the necessary amount, the determining means determines that the hot water in the hot water tank is deficient.

9. The hybrid water heater according to claim 1, wherein the hot-water supply equipment is a bathtub to which hot water stored in the hot water tank is supplied, the hybrid water heater further comprising a control unit for controlling combustion operation of the combustor, wherein:

the control unit determines whether or not a hot water state in the hot water tank is a supply capable state capable to supply hot water to the bathtub; and when it is determined that the hot water state in the hot water tank is a state incapable to supply hot water to the bathtub, the combustor is operated by the control unit to heat water in the chamber.

10. The hybrid water heater according to claim 1, further comprising a control unit for controlling combustion operation of the combustor, wherein:

the combustor is operated by the control unit to heat water in the chamber, when a command, for supplying hot water higher than that of the hot water in the hot water tank, is input into the control unit.

11. The hybrid water heater according to claim 1, further comprising:

a first water pipe through which tap water is supplied into the hot water tank at the lower side;

a second water pipe through which tap water is supplied into the chamber at the lower side; and a valve device disposed in the first water pipe, for controlling an amount of tap water supplied into the hot water tank.

12. The hybrid water heater according to claim 11, wherein the valve device is operated to restrict a supply of tap water into the hot water tank, when the combustor is operated.

13. The hybrid water heater according to claim 11, wherein the second water port has a passage sectional area smaller than that of the second water pipe.

14. The hybrid water heater according to claim 1, wherein:

the hot water tank is disposed to extend in a vertical direction; and the chamber is disposed adjacent to the hot water tank, to communicate with the hot water tank through the first water port and the second water port.

15. The hybrid water heater according to claim 14 further comprising:

a plurality of temperature sensors disposed in the hot water tank to be arranged in the vertical direction, for detecting temperature of water in the hot water tank at different height position; and a control unit for controlling operation of the combustor, wherein:

the control unit determines a hot-water deficiency state in the hot water tank based on signals from the temperature sensors; and when the hot-water deficiency state is determined, the combustor is operated by the control unit.

16. The hybrid water heater according to claim 15, wherein:

when the hot water deficiency state is eliminated, the operation of the combustor is stopped by the control unit.

17. The hybrid water heater according to claim 1, wherein the hot water tank has a hot water outlet at a top end side, from which hot water in the hot water tank is supplied toward the hot-water supply equipment.

* * * * *